US009592977B2

(12) United States Patent
Ota et al.

(10) Patent No.: US 9,592,977 B2
(45) Date of Patent: Mar. 14, 2017

(54) SHEET CONVEYING APPARATUS

(71) Applicant: BROTHER KOGYO KABUSHIKI KAISHA, Nagoya-shi, Aichi-ken (JP)

(72) Inventors: Yasuhira Ota, Yatomi (JP); Noriyuki Kawamata, Nagoya (JP); Takashi Omura, Inazawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/664,314

(22) Filed: Mar. 20, 2015

(65) Prior Publication Data

US 2015/0274461 A1 Oct. 1, 2015

(30) Foreign Application Priority Data

Mar. 28, 2014 (JP) ..... 2014-068559

(51) Int. Cl.
*B65H 5/06* (2006.01)
*B65H 3/56* (2006.01)
(Continued)

(52) U.S. Cl.
CPC ..... *B65H 5/068* (2013.01); *B65H 1/04* (2013.01); *B65H 3/0684* (2013.01); *B65H 3/56* (2013.01); *B65H 7/02* (2013.01); *B65H 7/20* (2013.01); *B65H 2402/46* (2013.01); *B65H 2403/53* (2013.01); *B65H 2404/6111* (2013.01);
(Continued)

(58) Field of Classification Search
CPC ..... B65H 5/068; B65H 3/56; B65H 3/0684; B65H 1/04; B65H 2551/514; B65H 2551/518; B65H 2553/412; B65H 2553/612
See application file for complete search history.

(56) References Cited

U.S. PATENT DOCUMENTS 8,424,863 B2 * 4/2013 Kita ..... B65H 3/44 271/265.01
9,114,946 B2 * 8/2015 Misawa ..... B65H 5/36
2013/0009359 A1 * 1/2013 Yamada ..... G03G 15/6502 271/264

FOREIGN PATENT DOCUMENTS

JP 6-186093 A 7/1993
JP 08217326 A * 8/1996
(Continued)

OTHER PUBLICATIONS

Notice of Reasons for Rejection from corresponding Japanese Patent Application No. 2014-068559, mailed Dec. 20, 2016.

*Primary Examiner* — Patrick Cicchino
(74) *Attorney, Agent, or Firm* — Merchant & Gould P.C.

(57) ABSTRACT

A first actuator is detected at a first detection position by a detecting unit when no sheet is held on a feed tray, and is not detected at a first non-detection position by the detecting unit when the first actuator is in contact with a sheet held on the feed tray. A second actuator is detected at a second detection position by the detecting unit when the second actuator is in contact, at a predetermined position downstream of the first actuator in a conveying direction, with a sheet conveyed, and is not detected at a second non-detection position by the detecting unit when the second actuator is out of contact, at the predetermined position, with the sheet conveyed. A restricting member restricts the first actuator from moving from the first non-detection position to the first detection position when the second actuator is at the second detection position.

13 Claims, 8 Drawing Sheets

(51) Int. Cl.

| | |
|---|---|
| ***B65H 3/06*** | (2006.01) |
| ***B65H 1/04*** | (2006.01) |
| ***B65H 7/02*** | (2006.01) |
| ***B65H 7/20*** | (2006.01) |

(52) U.S. Cl.
CPC *B65H 2405/1136* (2013.01); *B65H 2511/414* (2013.01); *B65H 2511/514* (2013.01); *B65H 2511/518* (2013.01); *B65H 2513/53* (2013.01); *B65H 2553/412* (2013.01); *B65H 2553/612* (2013.01)

(56) References Cited

FOREIGN PATENT DOCUMENTS

| | | | |
|---|---|---|---|
| JP | H08217326 | A | 8/1996 |
| JP | 9-118452 | A | 5/1997 |
| JP | 9-202491 | A | 8/1997 |
| JP | 2002-193488 | A | 7/2002 |

* cited by examiner

SHEET CONVEYING APPARATUS

CROSS-REFERENCE TO RELATED APPLICATION

This application claims priority from Japanese Patent Application No. 2014-068559, filed on Mar. 28, 2014, which is incorporated herein by reference in its entirety.

TECHNICAL FIELD

Aspects described herein relate to a sheet conveying apparatus.

BACKGROUND

A known sheet conveying apparatus is configured to convey sheets held in a feed tray to a recording unit. The known sheet conveying apparatus includes a single sensor, and first and second levers to be detected by the single sensor. The first lever is located at a position not to be detected by the sensor when a sheet or sheets are present in the feed tray, and pivots to a position to be detected by the sensor when no sheet is left in the feed tray. The second lever is configured to contact, at a predetermined position between the feed tray and the recording unit, a sheet fed from the feed tray and conveyed along a conveying path. The second lever, when out of contact with the sheet, is located at a position not to be detected by the sensor, and is kept at a pivoted position to be detected by the sensor after a leading end of the sheet passes through a predetermined position till a trailing end of the sheet passes through the predetermined position.

In the known sheet conveying apparatus, whether a trailing end of a sheet has passed through the predetermined position located along the conveying path is determined based on the sensor which changes from a detecting state to a non-detecting state. After the state of the sensor changes, a next sheet is fed from the feed tray.

SUMMARY

Aspects of the disclosures relate to a sheet conveying apparatus that may reliably detect the passing of a trailing end of each one of sheets fed from a feed tray while reducing the number of parts in the sheet conveying apparatus.

According to one or more aspects of the disclosure, a sheet conveying apparatus comprises a feed tray configured to hold sheets thereon, a conveying mechanism configured to convey a sheet fed from the feed tray along a conveying path in a conveying direction, a detecting unit configured to detect an object, a first actuator configured, as an object, to move between a first detection position and a first non-detection position, a second actuator configured, as an object, to move between a second detection position and a second non-detection position, and a restricting member. The first actuator is detected at the first detection position and is not detected at the first non-detection position by the detecting unit. The first actuator is configured to be located at the first non-detection position when the first actuator is in contact with a sheet held on the feed tray, and to be located at the first detection position when no sheet is held on the feed tray. The second actuator is detected at the second detection position and is not detected at the second non-detection position by the detecting unit. The second actuator is configured to be located at the second detection position when the second actuator is in contact, at a predetermined position, with the sheet conveyed by the conveying mechanism, and to be located at the second non-detection position when the second actuator is out of contact, at the predetermined position, with the sheet conveyed by the conveying mechanism. The predetermined position is a position downstream of the first actuator in the conveying direction. The restricting member is configured to restrict the first actuator from moving from the first non-detection position to the first detection position when the second actuator is located at the second detection position.

According to one or more aspects of the disclosure, A sheet conveying apparatus comprises a feed tray configured to hold sheets thereon, a conveying mechanism configured to convey a sheet fed from the feed tray along a conveying path in a conveying direction, a first actuator configured to move between a first position and a second position, a second actuator configured to move between a third position and a fourth position, a detecting unit configured to detect the first actuator and the second actuator and change between a first state and a second state in response to movement of the first actuator between the first position and the second position, respectively, and in response to movement of the second actuator between the third position and the fourth position, respectively, and a restricting member. The first actuator is located at the first position when no sheet is held on the feed tray and at the second position when one or more sheets are held on the feed tray. The second actuator is located at the third position when a sheet fed from the feed tray is passing through a predetermined position, which is a position downstream of the first actuator in the conveying direction, and at the forth position when the sheet fed from the feed tray is away from the predetermined position. The restrict member is configured to contact the first actuator and maintain the first actuator at the second position when the second actuator is at the third position.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
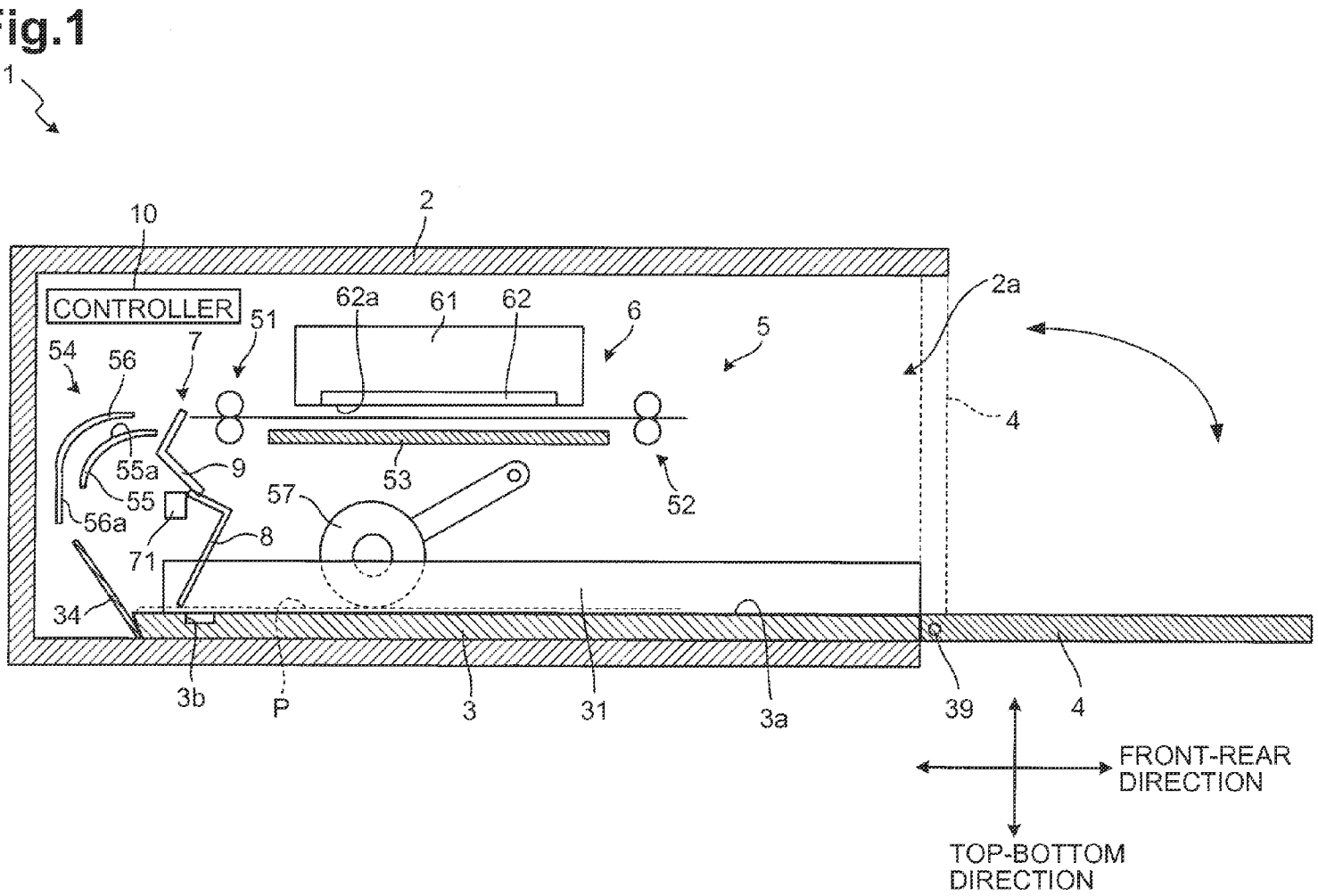
FIG. 1 is a schematic side view showing an internal configuration of an inkjet printer in an illustrative embodiment according to one or more aspects of the disclosure.

Illustrative embodiments according to one or more aspects are described below with reference to the accompanying drawings. The illustrative embodiments described below are only examples. Various changes, arrangements and modifications may be applied therein without departing from the spirit and scope of the disclosure. Hereinafter, a right face of an inkjet printer 1 in FIG. 1 is referred to as a front face, and a left face of the inkjet printer 1 in FIG. 1 is referred to as a rear face. A direction in which the front face and the rear face of the inkjet printer 1 oppose each other is referred to as a front-rear direction, and a direction which is horizontal and perpendicular to the front-rear direction is referred to as a width direction.

As shown in FIG. 1, the inkjet printer 1 includes a housing 2 having a generally rectangular parallelepiped shape, and an opening 2*a* is defined at the front of the housing 2. Sheets P subjected to image recording are supplied through the opening 2*a* and sheets having an image recorded thereon are discharged through the opening 2*a*. The opening 2*a* functions as a sheet supply port and a sheet discharge port. A display 21 (see FIG. 4) for notifying a user of printer states is disposed on an outer surface of the housing 2.

A feed tray 3 is disposed at a lower portion inside the housing 2 and has a holding surface 3*a* for holding sheets P thereon. A tray cover 4 is attached to the feed tray 3 via shafts 39 located at front ends of the feed tray 3. The tray cover 40 is pivotable between a first position (shown by a broken line in FIG. 1) in which the tray cover 40 closes the opening 2*a* and a second position (shown by a solid line in FIG. 1) in which the tray cover 40 defines the opening 2*a*.

The feed tray 3 includes side guides 31 for guiding side ends of sheets P held on the holding surface 3*a*. Upper portions of the side guides 31 support a sheet P having an image recorded thereon and conveyed by a conveying mechanism 5, which is described later, toward the opening 2*a*. An inclined plate 34 is attached, at its one end, to a rear end of the feed tray 3 such that its other end is located at a more upper rear position than its one end. A feed roller 57 is disposed above the feed tray 3 and is pivotable about a pivot shaft provided at the housing 2. The feed roller 57 feeds, one by one, sheets P held on the holding surface 3*a* to the rear such that a sheet P is pushed up along the inclined plate 34.

The housing 2 houses therein the conveying mechanism 5, a recording unit 6, a detection mechanism 7, and a controller 10. The conveying mechanism 5 conveys a sheet P from the feed tray 3 along a predetermined conveying path. The recording unit 6 records an image on the sheet P conveyed by the conveying mechanism 5. The detection mechanism 7 detects the presence or absence of a sheet P on the feed tray 3 and the passing of a sheet P conveyed to the recording unit 6. The controller 10 generally controls the inkjet printer 1.

The recording unit 6 includes a carriage 61 reciprocated by a carriage moving mechanism 61*a* (see FIG. 4) in a direction perpendicular to the drawing sheet of FIG. 1, and an inkjet head 6 mounted on the carriage 61. A lower surface of the inkjet head 6 is formed as an ejecting surface 62*a* having a plurality of nozzles (not shown) for ejecting ink.

In addition to the feed roller 57 for feeding a sheet P from the feed tray 3, as described above, the conveying mechanism 5 includes a convey roller pair 51, a discharge roller pair 52, and a platen 53, and a curved guide 54. The convey roller pair 51 is disposed behind the recording unit 6. The discharge roller pair 52 is disposed opposite to the convey roller pair 51 relative to the recording unit 6. The platen 53, which has a flat plate shape, is disposed facing the ejecting surface 62*a*. The curved guide 51 guides a sheet P fed by the feed roller 57 toward the convey roller pair 51. The convey roller pair 51 and the discharge roller pair 52 are driven by motors 51*a*, 52*a* (see FIG. 4), respectively, to convey the sheet P, along a path defined between the ejecting surface 62*a* and the platen 53, toward the front.

The curved guide 54 includes a first guide member 55 having a first guide surface 55*a* which is curved, and a second guide member 56 having a second guide surface 56*a* facing the first guide surface 55*a*. The sheet P fed from the feed tray 3 passes, along a path defined between the first guide surface 55*a* and the second guide surface 56*a*, toward the convey roller pair 51.

With the above-described configuration, the feed roller 57 feeds a sheet P from the feed tray 3 from the front toward the rear (from the right to the left in FIG. 1). The curved guide 54 guides the sheet P pushed up along the inclined plate 34 from the rear toward the front (from the left to the right in FIG. 1) such that the sheet P makes a U-turn. Thereafter, the convey roller pair 51 pinches the sheet P and conveys the sheet P toward the front, and the inkjet head 62 ejects ink onto the sheet P at a position facing the ejecting surface 62*a*, thereby recording an image thereon. The discharge roller pair 52 conveys the sheet P having the image recorded thereon toward the opening 2*a* and discharges the sheet P onto the upper portions of the side guide 31.

Figure 2A:
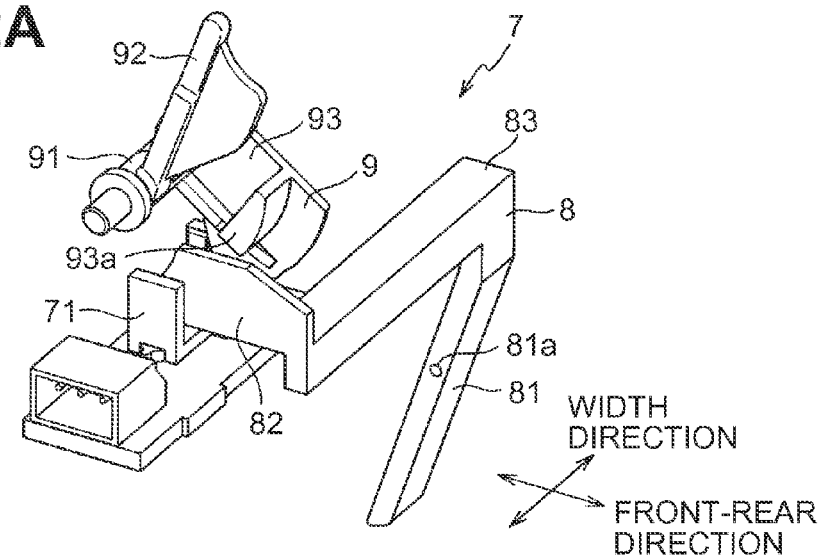
FIG. 2A is a perspective view of a detection mechanism shown in FIG. 1 in the illustrative embodiment according to one or more aspects of the disclosure, wherein a first actuator is at a first detection position and a second actuator is at a second non-detection position.
Figure 2B:
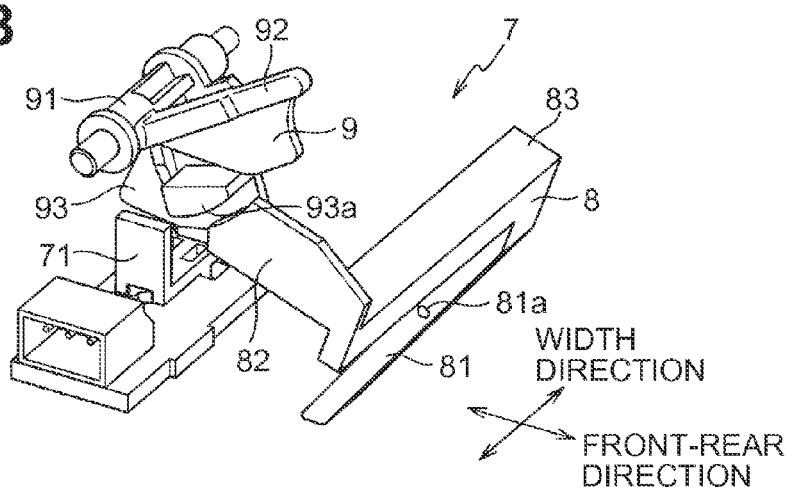
FIG. 2B is a perspective view of the detection mechanism shown in FIG. 1 in the illustrative embodiment according to one or more aspects of the disclosure, wherein the first actuator is at a first non-detection position and the second actuator is at a second detection position.
Figure 2C:
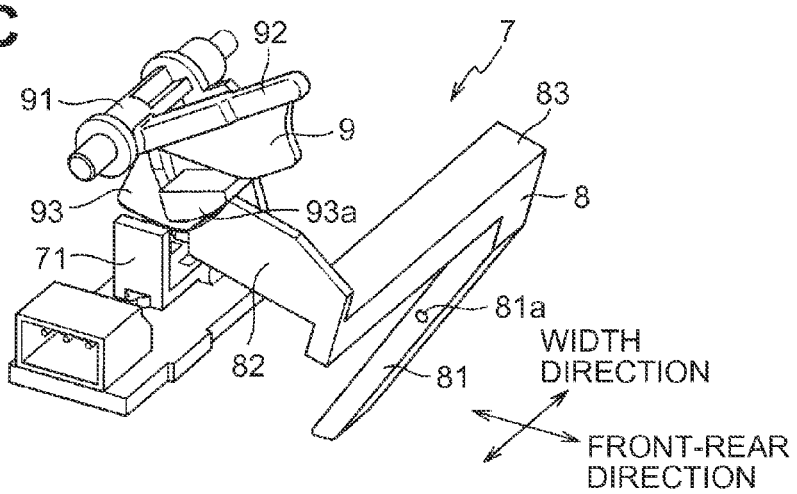
FIG. 2C is a perspective view of the detection mechanism shown in FIG. 1 in the illustrative embodiment according to one or more aspects of the disclosure, wherein the first actuator is restricted from pivoting.
Figure 3:
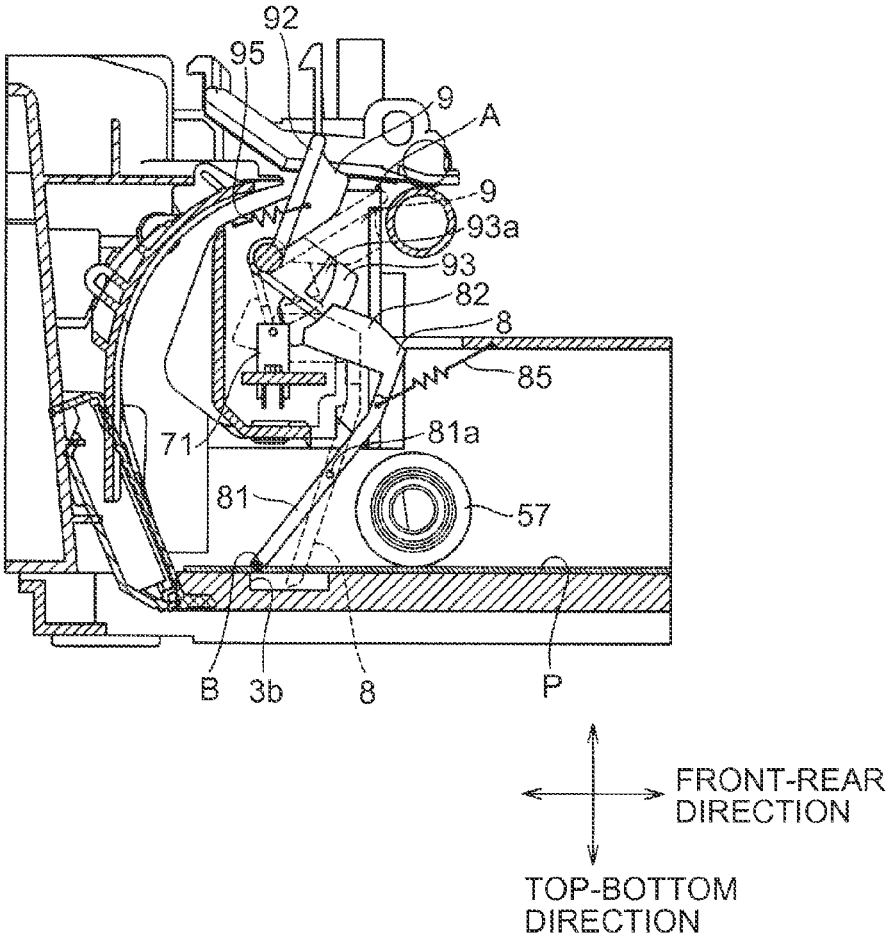
FIG. 3 is a view of a location of the detection mechanism enlarged from FIG. 1 in the illustrative embodiment according to one or more aspects of the disclosure.

With reference to FIGS. 2 and 3, the configuration of the detection mechanism 7 is now described. The detection mechanism 7 includes a sensor 71, a first actuator 8, and a second actuator 9. The sensor 7 is configured to detect an object located at a detection position. The first actuator 8 is movable between a first detection position (a position shown by a broken line in FIG. 3) at which the first actuator 8 is detected by the sensor 71, and a first non-detection position (a position shown by a solid line in FIG. 3) at which the first actuator 8 is not detected by the sensor 71. Whether or not a sheet P is present on the feed tray 3 is determined based on the movement of the first actuator 8. The second actuator 9 is movable between a second detection position (a position shown by a broken line in FIG. 3) at which the second actuator is detected by the sensor 71, and a second non-detection position (a position shown by a solid line in FIG. 3) at which the second actuator 9 is not detected by the sensor 71. Whether or not a sheet P passes through position A (see FIG. 3), which is between an outlet of the curved guide 54 and the convey roller pair 51, is determined based on the movement of the second actuator 9. The sensor 71, the first actuator 8, and the second actuator 9 are supported by the first guide member 55 of the curved guide 54.

In the illustrative embodiment, the sensor 71 is a transmission-type optical sensor including a light emitting element (not shown) and a light receiving element (now shown). The sensor 71 detects an object when the object is at a detection position, which is between the light emitting element and the light receiving element, and blocks a light beam emitted from the light emitting element.

As shown in FIGS. 2A and 2B, the first actuator 8 includes a contact portion 81 which contacts a sheet P held on the feed tray 3, a target portion 82 to be detected by the sensor 71, and a connecting portion which connects the contact portion 81 to the target portion 82. The connecting portion 81 extends in the width direction. The contact portion 81 is at one end of the connecting portion 81 and the target portion 82 is at the other end of the connecting portion 81. One end of the contact portion 81 is connected to the connecting portion 83. The contact portion 81 is shaped like a rod and extends in a direction perpendicular to the width direction. The target portion 82 is shaped like a plate having a surface perpendicular to the width direction and extends from the other end of the connecting portion in a direction perpendicular to the width direction and different from a direction in which the contact portion 81 extends. The first actuator 8 is pivotable about a pivot shaft 81*a* which is located in a central portion, in a longitudinal direction, of the contact portion 81 and extends in the width direction. The first actuator 8 is urged by a spring 85 (see FIG. 3), in a pivoting direction about the pivot shaft 81*a* (e.g., counterclockwise in FIG. 3), from the first non-detection position toward the first detection position.

When a sheet P is held on the feed tray 3, a distal end of the contact portion 81 of the first actuator 8 contacts a sheet P on the feed tray 3, as shown by a solid line in FIG. 3. At this time, the first actuator 8 is located at the first non-detection position at which the target portion 82 is not detected by the sensor 71. The feed tray 3 has a recess 3*b* recessed from the holding surface 3*a*. When no sheet P is held on the feed tray 3, the distal end of the contact portion 81 is in the recess 3*b* of the feed tray 3, as shown by a broken line in FIG. 3. At this time, the first actuator 8 is located at the first detection position at which the target portion 82 is detected by the sensor 71.

As shown in FIGS. 2A and 2B, the second actuator 9 includes a pivot shaft 91 extending in the width direction, a contact portion 92 which contacts a sheet P passing through position A, and a target portion 93 to be detected by the sensor 71. The contact portion 92 and the target portion 93 extend from respective different positions, in a longitudinal direction, of the pivot shaft 91 in respective different directions which are perpendicular to the width direction. The target portion 82 is shaped like a plate having a surface perpendicular to the width direction and is disposed to partially face the target portion 82 of the first actuator 8. The target portion 93 has a protrusion 93*a* protruding from its surface facing the target portion 82 of the first actuator 8. The second actuator 9 is pivotable about the pivot shaft 91 and is urged by a spring 95 (see FIG. 3), in a pivoting direction about the pivot shaft 91 (e.g., counterclockwise in FIG. 3), from the second detection position toward the second non-detection position.

Before a sheet P passes through position A, the contact portion 92 of the second actuator 9 is located in a sheet conveying path, as shown by a solid line in FIG. 3. At this time, the second actuator 9 is located at the second non-detection position at which the target portion 93 is not detected by the sensor 71. When the sheet P passes through position A, the contact portion 92 of the second actuator 9 receives the sheet P which moves the contact portion 92 out of the sheet conveying path, as shown by a broken line in FIG. 3. At this time, the second actuator 9 is located at the second detection position at which the target portion 93 is detected by the sensor 71.

As shown in FIG. 2B, when the second actuator 9 is at the second detection position, the protrusion 93*a* of the target portion 93 is positioned on a locus of the target portion 82 which moves as the first actuator 8 pivots from the first non-detection position to the first detection position. Thus, when the second actuator 9 is at the second detection position, the contact portion 81 of the first actuator 8 is out of contact with the sheet P. As shown in FIG. 2C, if the first actuator 8 attempts to pivot from the first non-detection position to the first detection position, the protrusion 93*a* contacts the target portion 82 of the first actuator 8 and restricts the first actuator 8 from pivoting to the first detection position.

The contact portion 81 contacts, at position B (see FIG. 3), the sheet P held on the feed tray 3A when the first actuator 1 is at the first non-detection position. The contact portion 92 contacts, at position A, the sheet P fed from the feed tray 3 when the second actuator 9 is at the second detection position. A distance between position B and position A along a sheet conveying path is less than or equal to a length, in the front-rear direction, of a sheet P of the smallest size held on the feed tray 3.

Figure 4:
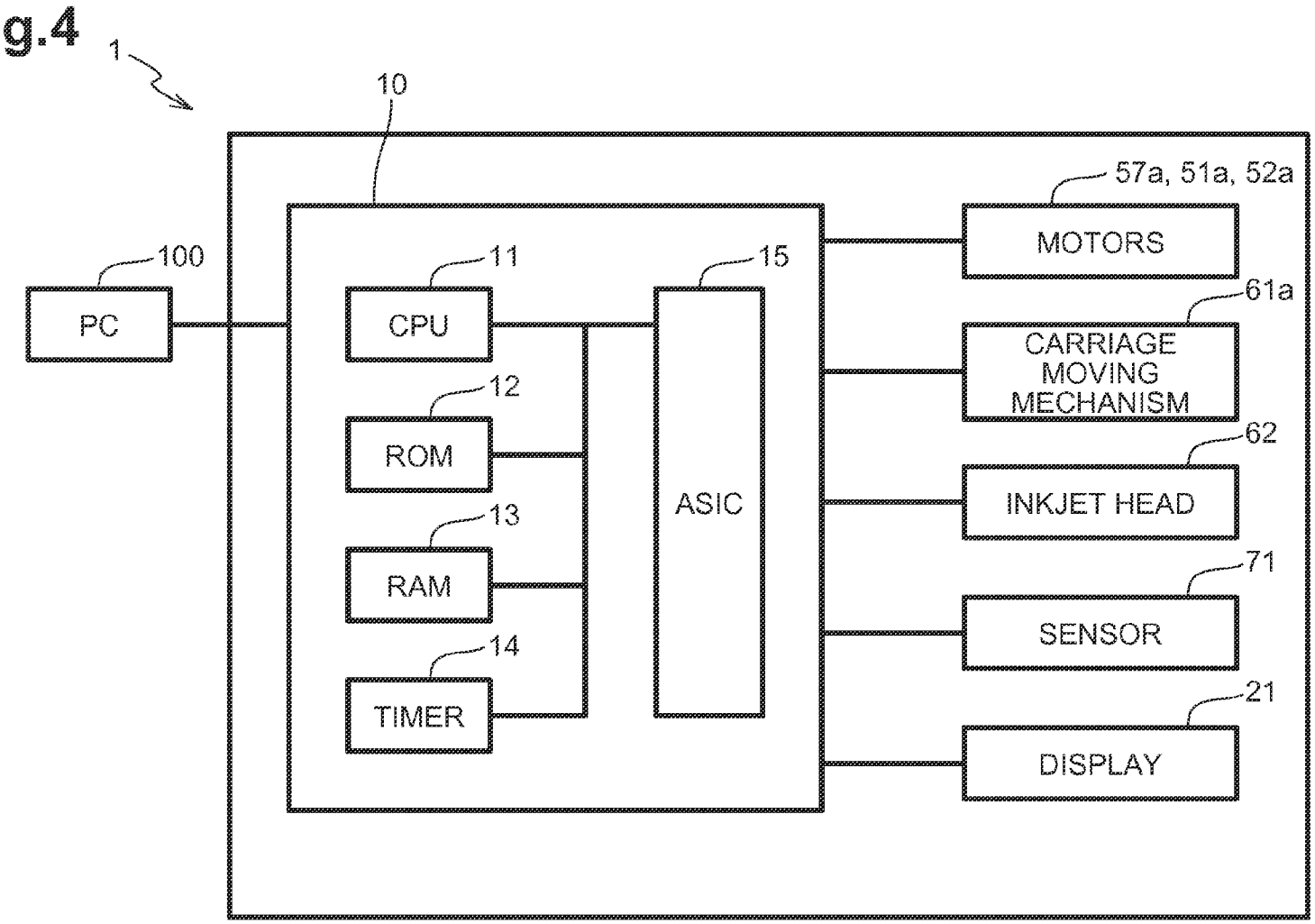
FIG. 4 is a schematic block diagram showing an electrical configuration of the inkjet printer shown in FIG. 1 in the illustrative embodiment according to one or more aspects of the disclosure.

With reference to FIG. 4, the controller 10 is now described. The controller 10 includes a central processing unit (CPU) 11, a read-only memory (ROM) 12, a random-access memory (RAM) 13, a timer 14, and an application-specific integrated circuit (ASIC) 15 which are connected with each other by a bus. The timer 14 measures a time based on clock signals issued by a clock signal oscillator (not shown). The motors 57*a*, 51*a*, 52*a* for respectively driving the feed roller 57, the convey roller pair 51, and the discharge roller pair 52, the carriage moving mechanism 61*a* for moving the carriage 61, the inkjet head 62, the sensor 71, the display 21 and the like are connected to the controller 10. In addition, an external device PC 100 is connected to the controller 10.

The controller 10 controls each component of the inkjet printer 1 through the CPU and the ASIC 15. In other embodiments, for example, the controller 10 may include a plurality of CPUs which share processes, or the controller 10 may include a plurality of ASICs which share processes. Alternatively, a single ASIC may execute all the processes.

In the illustrative embodiment, the controller 10 determines whether or not a sheet P is present on the feed tray 3 and whether or not a sheet P has passed through position A, based on detection signals of the sensor 71. Then the controller 10 controls the motors 57*a*, 51*a*, 52*a* for driving the feed roller 57, the convey roller pair 51, and the discharge roller pair 52, the carriage moving mechanism 61*a*, and the inkjet head 62. The controller 10 also controls the display 12 to display thereon information about whether or not a sheet P is present on the feed tray 3.

Figure 5:
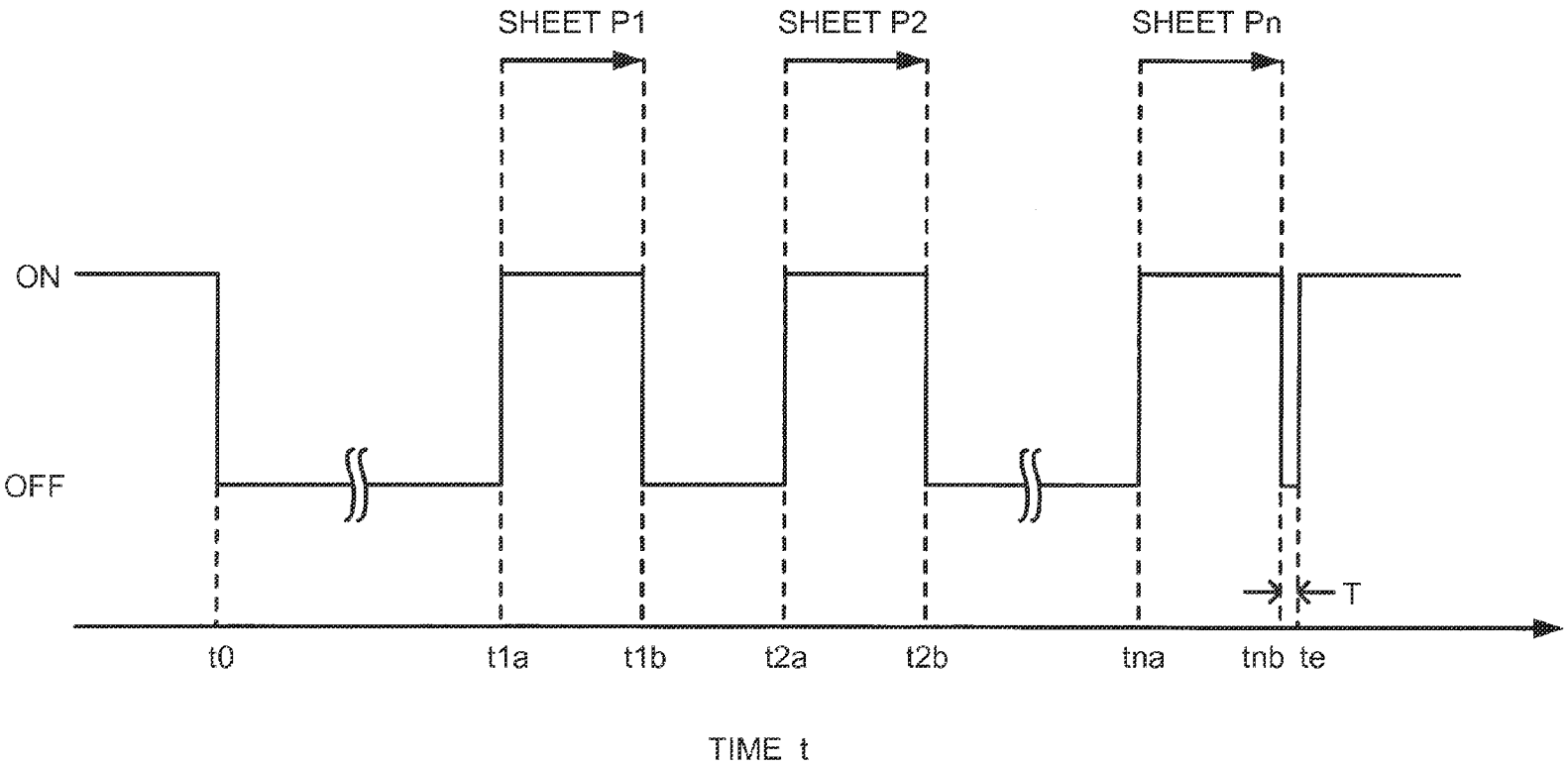
FIG. 5 is a diagram showing changes of detection signals of a sensor depending on the conveyance timing of sheets.

With reference to FIGS. 5-8, a process executed by the controller 10 is now described as an example. FIG. 5 shows the timings at which each of the sheets P passes through position A and the changes of output signals from the sensor 71 when sheets P are fed sequentially from the feed tray 3 which holds first to nth sheets P1-Pn thereon.

Figure 8:
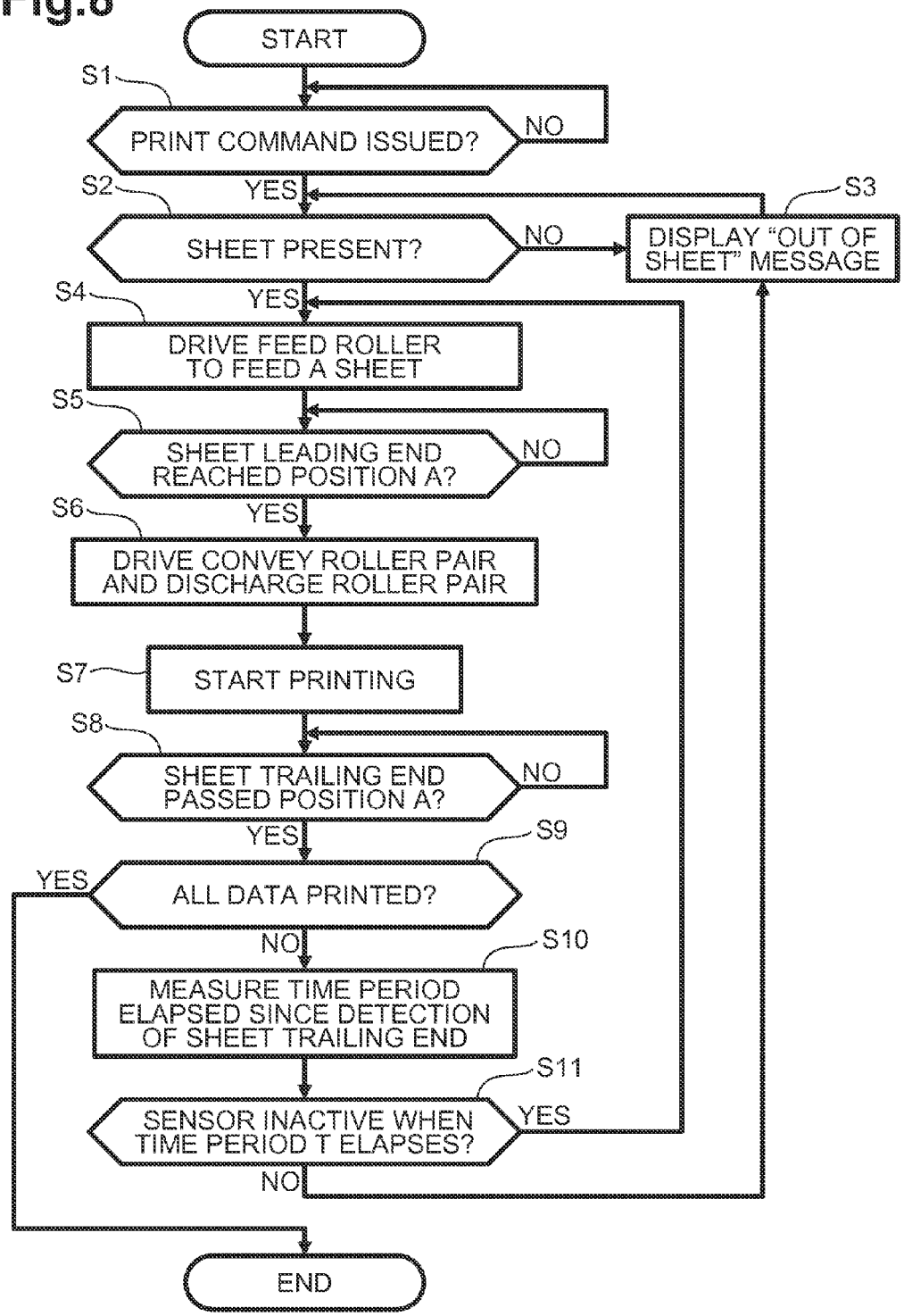
FIG. 8 is a flowchart showing an example of processes executed by a controller shown in FIG. 4 in the illustrative embodiment according to one or more aspects of the disclosure.

As shown in FIG. 8, the controller 10 determines whether or not a print command is sent from the PC 100 in S1 (e.g., step S1). When no print command is sent from the PC 100 (e.g., No in step S1), the controller repeats a determination of step S1 until a print command is sent form the PC 100. When a print command is sent from the PC 100 (e.g., Yes in step S1), the controller 10 determines whether or not a sheet P is held on the feed tray 3 (e.g., step S2).

Figure 6A:
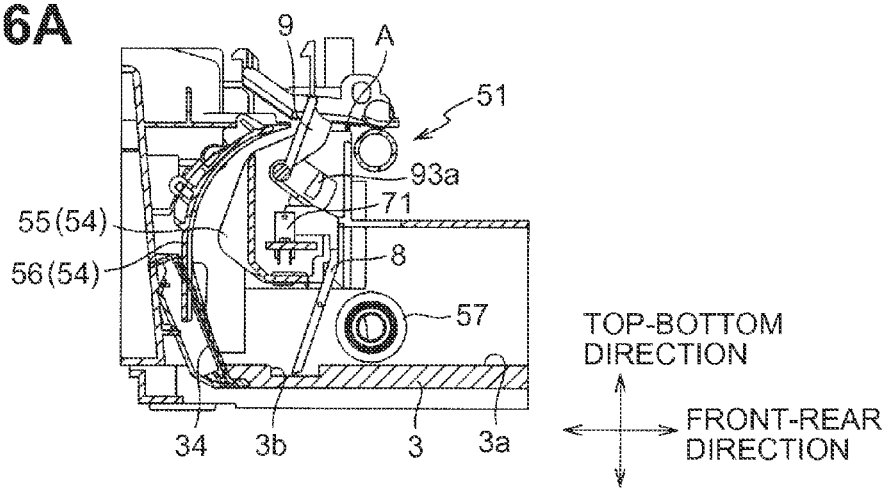
FIG. 6A is a side view showing movements of the detection mechanism shown in FIG. 1, in the illustrative embodiment according to one or more aspects of the disclosure, wherein no sheet is held on a feed tray.

When no sheet is held on the feed tray 3 as shown in FIG. 6A, the first actuator 8 is at the first detection position, and the sensor 71 is in an active state in which the sensor 71 detects an object. At this time, the second actuator 9 is at the second non-detection position. Subsequently, when sheets P are supplied to the feed tray 3, the first actuator 8 moves from the first detection position to the first non-detection position. At this time, the second actuator 9 is still at the second non-detection position, the sensor 71 is brought from the active state into an inactive state in which the sensor 71 does not detect an object. That is, as shown in FIG. 5, an output signal from the sensor 71 changes from ON to OFF approximately at a time t0 when sheets P are supplied to the feed tray 3. The controller 10 determines that a sheet P or sheets P have been supplied to the feed tray 3 based on the changes of detection signals of the sensor 71.

Referring back to FIG. 8, when the controller 10 determines that no sheet P is held on the feed tray 3 (e.g., No in step S2), the controller 10 controls the display 21 to display a message that the feed tray 3 is out of sheet (e.g., step S3) and repeats a determination of step S2. When the controller 10 determines that a sheet P or sheets P are held on the feed tray 3 (e.g., Yes in step S2), the controller 10 drives the feed roller 57 to feed a sheet Pn from the feed tray 3 (e.g., step S4). Subsequently, the controller 10 determines whether or not a leading end of the sheet P has reached position A (e.g., step S5).

Figure 6B:
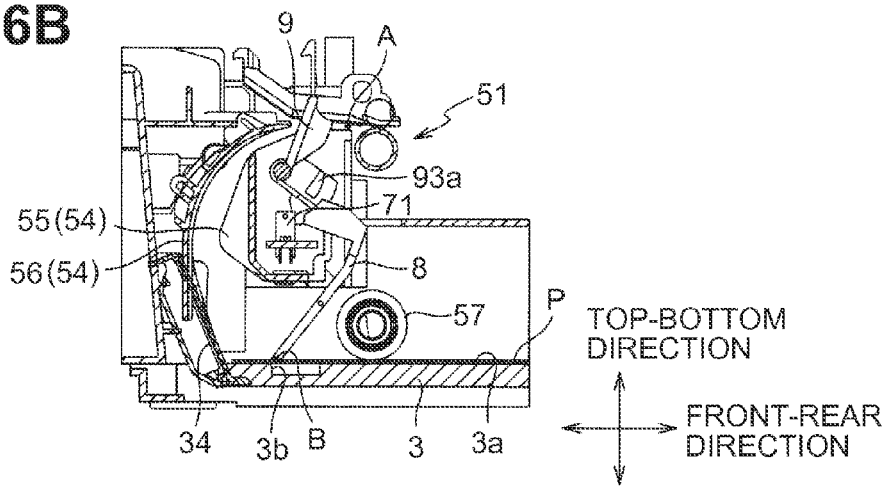
FIG. 6B is a side view showing movements of the detection mechanism shown in FIG. 1, in the illustrative embodiment according to one or more aspects of the disclosure, wherein sheets are held on the feed tray.
Figure 6C:
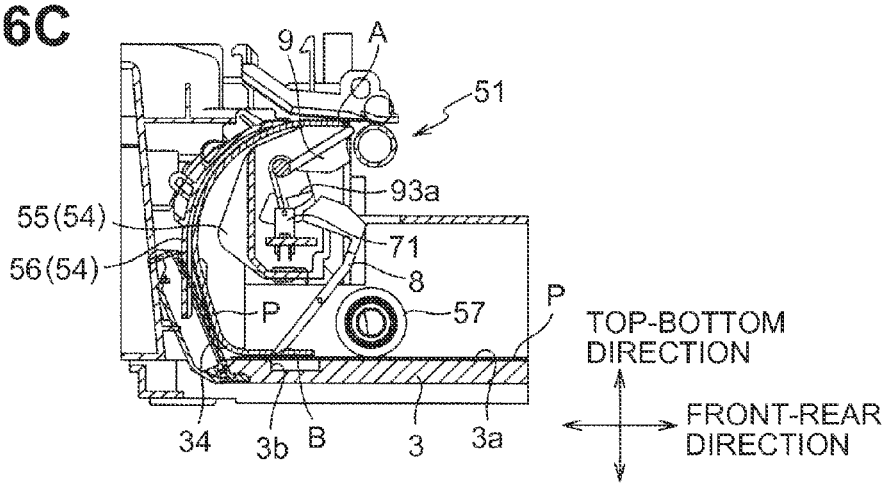
FIG. 6C is a side view showing movements of the detection mechanism, in the illustrative embodiment according to one or more aspects of the disclosure, wherein a leading end of a sheet fed from the feed tray reaches position A.
Figure 7A:
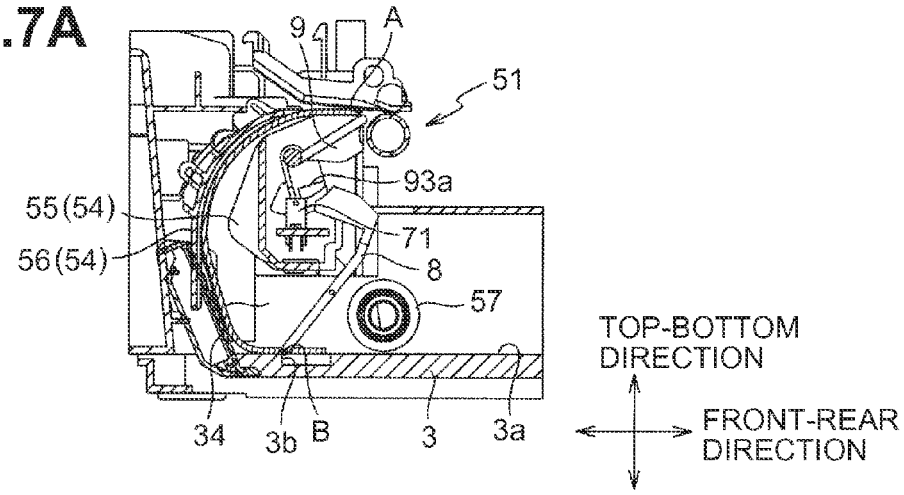
FIG. 7A is a side view showing movements of the detection mechanism, in the illustrative embodiment according to one or more aspects of the disclosure, wherein a leading end of the last sheet fed from the feed tray reaches position A.
Figure 7B:
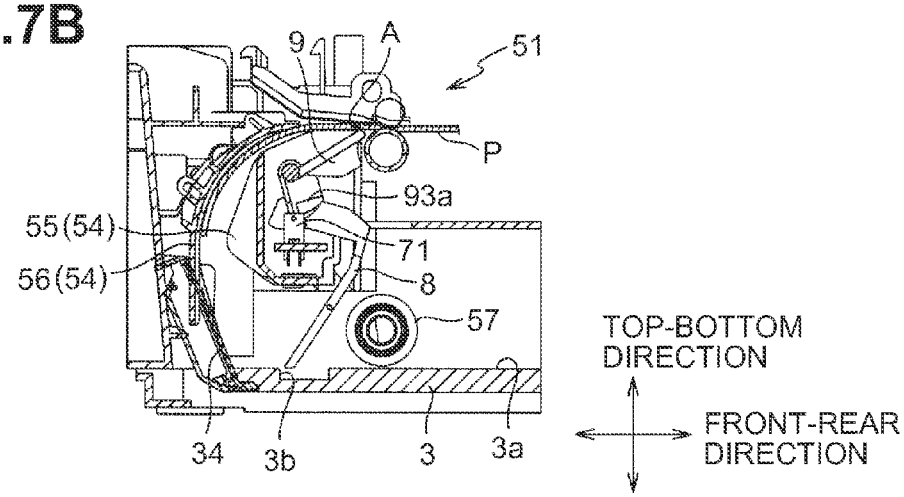
FIG. 7B is a side view showing movements of the detection mechanism, in the illustrative embodiment according to one or more aspects of the disclosure, wherein the last sheet fed from the feed tray has left the first actuator.

When the leading end of the sheet P fed from the feed tray 3 reaches position A, the second actuator 9 moves from the second non-detection position to the second detection position, thereby bringing the sensor 71 from an inactive state into an active state, as shown in FIGS. 6C and 7A. Thus, as shown in FIG. 5, output signals from the sensor 71 change from OFF to ON approximately at times t1*a*, t2*a*, tna when a leading end of each of first to nth sheets P reaches position A. At each time, the controller 10 determines that a leading end of a corresponding sheet P fed from the feed tray 3 has reached position A, based on the changes of detection signals of the sensor 71.

As already described, a distance, along the sheet conveying path, between position A and position B is less than or equal to a length, in a conveying direction, of a sheet P. The second actuator 9 contacts, at position A, a sheet P conveyed by the conveying mechanism 5. The first actuator 8 contacts, at position B, a sheet P held on the feed tray 3. Thus, when a leading end of a sheet P fed from the feed tray 3 reaches position A, the first actuator 8 is still in contact with the sheet P. Accordingly, as shown in FIG. 7A, when a leading end of the last sheet fed from the feed tray 3 reaches position A, the first actuator 8 is still in contact with the last sheet P and is located at the first non-detection position.

Referring back to FIG. 8, when the controller 10 does not determine that a leading end of the sheet P has reached position A (e.g., No in step S5), the controller 10 repeats a determination of step S5 until the controller 10 determines that a leading end of the sheet P has reached position A. When the controller 10 determines that a leading end of the sheet P has reached position A (e.g., Yes in step S5), the controller 10 starts driving the convey roller pair 51 and the discharge roller pair 52 (e.g., step S6). When a predetermined time period has elapsed after the controller 10 makes an affirmative determination in step S5, the controller drives the carriage moving mechanism 61*a* and the inkjet head 62 to start image recording on the sheet P (e.g., step S7). Subsequently, the controller 10 determines whether or not a trailing end of the sheet P has passed through position A (e.g., step S8).

As already described, when a sheet P fed from the feed tray 3 is the last sheet P held on the feed tray 3 and its leading end reaches position A, the first actuator 8 is located at the first non-detection position. When the leading end of the last sheet P is conveyed further beyond position A and a trailing end of the last sheet P passes through position B, the first actuator 8 contacts the protrusion 93*a* of the second actuator 9, thereby being restricted from pivoting from the first non-detection position to the first detection position. When a sheet fed from the feed tray 3 is not the last sheet P held on the feed tray 3 and its trailing end passes through position B, the first actuator 8 contacts another sheet to be fed next from the feed tray 3, there by being kept at the first non-detection position.

Figure 7C:
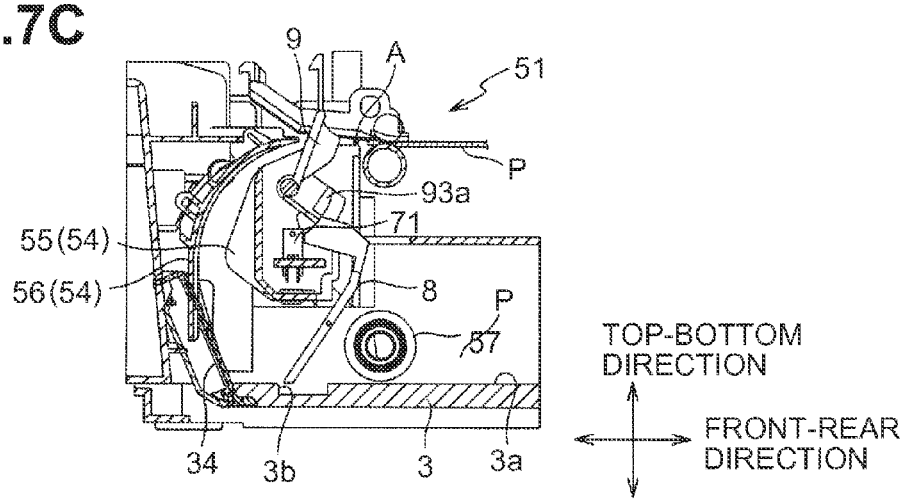
FIG. 7C is a side view showing movements of the detection mechanism 1, in the illustrative embodiment according to one or more aspects of the disclosure, wherein a trailing end of the last sheet fed from the feed tray has passed through position A.

When the trailing end of the sheet P has passed through position A, the second actuator 9 moves back to the second non-detection position, thereby bringing the sensor 71 form an active state into an inactive state, as shown in FIGS. 6B and 7C. Thus, as shown in FIG. 5, output signals from the sensor 71 change from ON to OFF approximately at times t1*b*, t2*b*, tnb when a trailing end of each of first to nth sheets P passes through position A. At each time, the controller 10 determines that a trailing end of a corresponding sheet P has passed through position A, based on the changes of detection signals of the sensor 71.

When a trailing end of the last sheet P passes through position A at a time tnb, the second actuator 9 moves to the second non-detection position, thereby bringing the first actuator 8 out of contact with the protrusion 93*a* of the second actuator 9, as shown in FIG. 7C. The first actuator 8 is released from the protrusion 93*a* which restricts the first actuator 8 from pivoting from the first non-detection position to the first detection position. Thus, as shown in FIG. 6A, immediately after the trailing end of the last sheet P passes through position A, the first actuator 8 moves to the first detection position, thereby bringing the sensor 71 from an inactive state into an active state. Accordingly, as shown in FIG. 5, output signals from the sensor 71 change from OFF to ON at a time te which is immediately after the time tnb. In the illustrative embodiment, a time period from the time tnb to the time te is referred to as a predetermined time period T. The sensor 71 is brought into an inactive state at the time tnb at which a trailing end of the last sheet passes through position A, and is brought back into an active state at the time te.

Referring back to FIG. 8, when the controller 10 does not determine that a trailing end of the sheet P has passed through position A (e.g., No in step S8), the controller repeats a determination of step S8 until the controller 10 makes an affirmative determination. When the controller 10 determines that a trailing end of the sheet P has passed through position A (e.g., Yes in step S8), the controller 10 determines whether or not printing of all the print data contained in a print command is completed (e.g., step S9). When the controller 10 determines that printing of all the print data is completed (e.g., Yes in step S9), the controller 10 ends the process. On the other hand, when the controller 10 determines that printing of all the print data is not completed (e.g., No in step S9), the controller 10 measures a time period elapsed since the detection, in step S8, of a trailing end of the sheet P (e.g., step S10), and determines whether or not the sensor 71 is in an inactive state when the measured time period reaches the predetermined time period T (e.g., step S11).

As already described, the sensor 71 is brought into an active state when the predetermined time period T elapses since a trailing end of the last sheet Pn fed from the feed tray 3 has passed through position A. Thus, if the sensor 71 is in an inactive state when the predetermined time period T elapses, it can be determined that a sheet P is present on the feed tray 3. Thus, if the sensor 71 is not in an inactive state (i.e. if the sensor 71 is in an active state) when the measured time period reaches the predetermined time period T (e.g., No in step S11), the controller 10 goes back to step S3 to control the display 21 to display the "out of sheet" message and repeats a determination in step S2. On the other hand, if the sensor 71 is in an inactive state when the measured time period reaches the predetermined time period T (e.g., Yes in step S2), the controller goes back to step S4 to drive the feed roller 57 to feed a sheet P from the feed tray 3.

According to the illustrative embodiment, the inkjet printer 1 includes the first actuator 8 and the second actuator 9. When the first actuator 8 is in contact with a sheet P held on the feed tray 3, the first actuator 8 is located at the first non-detection position and is not detected by the sensor 71. When no sheet P is held on the feed tray 3, the first actuator 8 is located at the first detection position and is detected by the sensor 71. When the second actuator 9 is in contact with a sheet P at the predetermined position A which is downstream of the first actuator 8 in the conveying direction, the second actuator 9 is located at the second detection position and is detected by the sensor 71. When the second actuator 9 is out of contact with any sheet P at the predetermined position A, the second actuator 9 is located at the second non-detection position and is not detected by the sensor 71. When the second actuator 9 is located at the second detection position, the protrusion 93*a* restricts the first actuator 8 from moving from the first non-detection position to the first detection position. Thus, as long as the second actuator 9 is located at the second detection position after the last sheet P held on the feed tray 3 is fed from the feed tray 3, the protrusion 93*a* prevents the first actuator 8 from moving from the first non-detection position to the first detection position. This allows the sensor 71 to detect a trailing end of the last sheet P when the trailing end of the last sheet passes through the predetermined position A thereby to move the second actuator 9 from the second detection position to the second non-detection position.

According to the illustrative embodiment, a distance, along the conveying path, from position B, at which the first actuator 8 contacts a sheet P held on the feed tray 3, to the predetermined position A is less than or equal to a length, in the conveying direction, of the sheet. Thus, a leading end of the last sheet P fed from the feed tray 3 reaches the predetermined position A and moves the second actuator 9 to the second detection position while the last sheet P is in contact with the first actuator 1 and keeps the first actuator 1 at the first non-detection position. As long as the second actuator 9 is located at the second detection position even after a trailing end of the last sheet P passes through position B and the last sheet P leaves the first actuator 8, the protrusion 93*a* reliably restricts the first actuator 8 from moving from the first non-detection position to the first detection position. Thus, whether the trailing end of the last sheet passes through the predetermined position A can be determined based on the movement of the second actuator from the second detection position to the second non-detection position.

According to the illustrative embodiment, the first actuator 8 is configured to pivot between the first detection position and the first non-detection position, and the second actuator 9 is configured to pivot between the second direction position and the second non-detection position. The first actuator 8 and the second actuator 9 may move between respective detection positions and non-detection positions with a relatively simple configuration.

According to the illustrative embodiment, the spring 85 urges the first actuator 8 toward the first detection position, and the spring 95 urges the second actuator 9 toward the second non-detection position. The spring 85 allows the first actuator to reliably move from the first non-detection position to the first detection position, and the spring 95 allows the second actuator to reliably move from the second detection position to the second non-detection position.

According to the illustrative embodiment, the second actuator 9 includes the protrusion 93*a* which restricts the pivoting of the first actuator 8. The protrusion 93*a* moves as the second actuator 9 moves. This allows the protrusion 93*a* to restrict or release the first actuator 1 in response to the movement of the second actuator 9.

According to the illustrative embodiment, the protrusion 93*a* contacts the first actuator 8 when the second actuator 9 is at the second detection position, thereby restricting the first actuator 8 from pivoting from the first non-detection position to the first detection position. The movement of the first actuator 8 may be restricted with a relatively simple configuration.

According to the illustrative embodiment, the feed tray 3 has the recess 3*b* recessed from the holding surface 3*a* for holding sheets P. The distal end of the first actuator 8, when at the first detection position, is accommodated in the recess 3*b*. This ensures a space sufficient enough for the first actuator 8 to move between the first non-detection position at which the first actuator 8 contacts a sheet p held on the feed tray 3 and the first detection position.

According to the illustrative embodiment, the conveying mechanism 5 includes the curved guide 54 for guiding a sheet P fed from the feed tray 3 toward the convey roller pair 51. The curved guide 54 includes the first guide member 55 having the first guide surface 55*a*, and the second guide member 56 having the second guide surface 56*a*. The sensor 71, the first actuator 8, and the second actuator 9 of the detection mechanism 7 are supported by the first guide member 55. This allows the detection mechanism 7 to be accommodated in a compact manner in the space defined by the first guide member 55.

According to the illustrative embodiment, the inkjet printer 1 includes the display 21 for reporting information to a user. The controller 10 measures a time period elapsed since the sensor 71 has changed from an active state in which the sensor 71 detects an object to an inactive state in which the sensor 71 does not detect the object, and controls the display 21 to display a message that the feed tray 3 is out of sheet when the sensor 71 changes from the inactive state to an active state by the time the measured time period reaches the predetermined time period T. This allows the controller 10 to detect an out-of-sheet state of the feed tray 3 based on output signals from the sensor 71.

In the above-described embodiment, the first actuator 8 and the second actuator 9 pivot between respective detection positions and respective non-detection positions. Nevertheless, in other embodiments, the first actuator 8 and the second actuator 9 may move vertically or horizontally between respective detection positions and respective non-detection positions.

In the above-described embodiment, the first actuator 8 is urged by the spring 85 toward the first detection position, and the second actuator 9 is urged by the spring 95 toward the second non-detection position. Nevertheless, in other embodiments, the first actuator 8 and the second actuator 9 may be urged by urging members, e.g., a rubber member, other than the spring. Alternatively, the first actuator 8 and the second actuator 9 may not be urged and may move by their own weights or by the principle of leverage to the first detection position and the second non-detection position, respectively.

In the above-described embodiment, the protrusion 93*a* of the second actuator 9 contacts the first actuator 8 to restrict the first actuator 8 from pivoting from the first non-detection position to the first detection position. Nevertheless, in other embodiments, an element for restricting the pivoting of the first actuator 8 may be provided at other members than the second actuator 9. Alternatively, the pivoting of the first actuator 8 may be restricted magnetically or electrically.

In the above-described embodiment, the distal end of the first actuator 8, when at the first detection position, is located in the recess 3*b* in the supporting surface 3*a* for holding sheets P. Nevertheless, in other embodiments, the recess 3*b* may not be provided.

In the above-described embodiment, the sensor 71, the first actuator 8, and the second actuator 9 of the detection mechanism 7 are supported by the first guide member 55 of the curved guide 54 but, in other embodiments, may be supported by other members than the first guide member 55.

In the above-described embodiment, the sensor 71 is a transmission type optical sensor but, in other embodiments, may be a reflection type optical sensor or an electromagnetic sensor or sonic or ultrasonic sensors.

In the above-described embodiment, the display 21 is provided as a notifying unit for notifying a user of information. Nevertheless, in other embodiments, a speaker which generates sounds or a lamp which turns on and off may be used as the notifying unit.

Although the disclosure has been described based on illustrative embodiments and variations, the illustrative embodiments of the disclosure facilitate the understanding of the disclosure and do not limit the disclosure. The disclosure may be changed or modified without departing from the spirit of the invention and the scope of the claims and includes the equivalents thereof.

What is claimed is:

1. A sheet conveying apparatus comprising:

a feed tray configured to hold sheets thereon;

a conveying mechanism configured to convey a sheet fed from the feed tray along a conveying path in a conveying direction;

a detecting unit configured to detect an object;

a first actuator configured, as an object, to move between a first detection position at which the first actuator is detected by the detecting unit, and a first non-detection position at which the first actuator is not detected by the detecting unit, the first actuator being configured to be located at the first non-detection position when the first actuator is in contact with a sheet held on the feed tray, and to be located at the first detection position when no sheet is held on the feed tray;

a second actuator configured, as an object, to move between a second detection position at which the second actuator is detected by the detecting unit, and a second non-detection position at which the second actuator is not detected by the detecting unit, the second actuator being configured to be located at the second detection position when the second actuator is in contact, at a predetermined position, with the sheet conveyed by the conveying mechanism, and to be located at the second non-detection position when the second actuator is out of contact, at the predetermined position, with the sheet conveyed by the conveying mechanism, the predetermined position being a position downstream of the first actuator in the conveying direction, wherein the first and second actuators are configured to:

restrict the first actuator from moving from the first non-detection position to the first detection position when the second actuator is located at the second detection position, even after a last sheet fed from the feed tray leaves the feed tray to empty the feed tray; and allow the first actuator to move from the first non-detection position to the first detection position within a predetermined time period when the second actuator moves to the second non-detection position upon passing of a trailing end of the last sheet through the predetermined position;

a notifying unit configured to notify a user of information; and a controller configured to control the notifying unit, wherein the controller is configured to execute:

measuring a time period elapsed since the detecting unit has chanced from a detecting state in which the detecting unit detects at least one of the first actuator and the second actuator, to a non-detecting state in which the detecting unit detects none of the first actuator and the second actuator, and controlling the notifying unit to notify the user that no sheet remains on the feed tray if the detecting unit changes from the non-detecting state to the detecting state by the time the measured time period reaches the predetermined time period.

2. The sheet conveying apparatus according to claim 1, wherein a distance, along the conveying path, from a position at which the first actuator is in contact with the sheet held on the feed tray to the predetermined position is less than or equal to a length, in the conveying direction, of the sheet held on the feed tray.

3. The sheet conveying apparatus according to claim 1, wherein the first actuator is configured to pivot between the first detection position and the first non-detection position, and the second actuator is configured to pivot between the second detection position and the second non-detection position.

4. The sheet conveying apparatus according to claim 1, wherein the second actuator is configured to move from the second non-detection position to the second detection position when a leading end of the last sheet fed from the feed tray reaches the predetermined position while the first actuator is in contact with the last sheet and located at the first non-detection position.

5. The sheet conveying apparatus according to claim 1, further comprising a first urging member configured to urge the first actuator toward the first detection position.

6. The sheet conveying apparatus according to claim 1, further comprising a second urging member configured to urge the second actuator toward the second non-detection position.

7. The sheet conveying apparatus according to claim 1, wherein the second actuator includes a restricting member configured to restrict the first actuator from moving from the first non-detection position to the first detection position.

8. The sheet conveying apparatus according to claim 7, wherein the restricting member is configured to, when the second actuator is located at the second detection position, contact the first actuator and maintain the first actuator at the first non-detection position.

9. The sheet conveying apparatus according to claim 1, wherein the feed tray has a holding surface for holding the sheets thereon and a recess recessed from the holding surface, and wherein a portion of the first actuator is configured to be accommodated in the recess when the first actuator is located at the first detection position.

10. The sheet conveying apparatus according to claim 1, wherein the conveying mechanism includes:

a feed roller configured to feed a sheet from the feed tray;

a conveying roller pair configured to nip and convey the sheet fed by the feed roller;

a curved guide configured to guide the sheet fed by the feed roller to the conveying roller pair, the curved guide including a first guide member having a first curved surface, and a second guide member having a second curved surface which faces the first curved surface, wherein the detecting unit, the first actuator, and the second actuator are disposed at the first guide member.

11. A sheet conveying apparatus comprising:

a feed tray configured to hold sheets thereon;

a conveying mechanism configured to convey a sheet fed from the feed tray along a conveying path in a conveying direction;

a first actuator configured to move between a first position at which the first actuator is located when no sheet is held on the feed tray, and a second position at which the first actuator is located when one or more sheets are held on the feed tray;

a second actuator configured to move between a third position at which the second actuator is located when a sheet fed from the feed tray is passing through a predetermined position, and a fourth position at which the second actuator is located when the sheet fed from the feed tray is away from the predetermined position, the predetermined position being a position downstream of the first actuator in the conveying direction;

a detecting unit configured to detect the first actuator and the second actuator and change between a first state and a second state in response to movement of the first actuator between the first position and the second position, respectively, and in response to movement of the second actuator between the third position and the fourth position, respectively, wherein the first actuator is configured to:

be maintained at the second position when the second actuator is at the third position, even after a last sheet fed from the tray leaves the feed tray to empty the feed tray; and move from the second position to the first position within a predetermined time period when the second actuator moves to the fourth position upon passing of a trailing end of the last sheet through the predetermined position;

a notifying unit configured to notify a user of information; and a controller configured to control the notifying unit to notify the user that no sheet remains on the feed tray if the detecting unit changes from the second state to the first state within the predetermined time period after the detecting unit changes from the first state to the second state.

12. The sheet conveying apparatus according to claim 11, wherein the first actuator is configured to be located at the second position when a leading end of the last sheet fed from the feed tray reaches the predetermined position.

13. The sheet conveying apparatus according to claim 7, wherein the restricting member comprises a protrusion extending from the second actuator.

* * * * *